US011127348B2

(12) United States Patent
Li et al.

(10) Patent No.: US 11,127,348 B2
(45) Date of Patent: Sep. 21, 2021

(54) PIXEL CIRCUIT, DRIVING METHOD THEREOF AND DISPLAY DEVICE

(71) Applicant: BOE TECHNOLOGY GROUP CO., LTD., Beijing (CN)

(72) Inventors: Junjie Li, Beijing (CN); Yuanyuan Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/845,113

(22) Filed: Apr. 10, 2020

(65) Prior Publication Data

US 2020/0243009 A1 Jul. 30, 2020

Related U.S. Application Data

(63) Continuation of application No. 15/989,732, filed on May 25, 2018, now Pat. No. 10,657,889.

(30) Foreign Application Priority Data

Aug. 17, 2017 (CN) ..... 201710705821.9

(51) Int. Cl.
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0251* (2013.01); *G09G 2310/0262* (2013.01); *G09G 2320/0233* (2013.01); *G09G 2320/045* (2013.01)

(58) Field of Classification Search
CPC ..... G09G 3/3233; G09G 2320/045; G09G 2310/0262; G09G 2300/0861; G09G 2310/0251
See application file for complete search history.

(56) References Cited

U.S. PATENT DOCUMENTS

2018/0130410 A1 5/2018 Gao et al.
2018/0130424 A1* 5/2018 Gao ..... H01L 27/1251

FOREIGN PATENT DOCUMENTS

CN 103985352 8/2014
CN 104157240 11/2014
(Continued)

OTHER PUBLICATIONS

Office action from U.S. Appl. No. 15/989,732 dated Jul. 18, 2019.
(Continued)

*Primary Examiner* — Dennis P Joseph
(74) *Attorney, Agent, or Firm* — Calfee, Halter & Griswold LLP

(57) ABSTRACT

The present disclosure provides a pixel circuit and a driving method thereof, a display device. The pixel circuit includes a reset sub-circuit, a compensation sub-circuit, a data writing sub-circuit, a storage capacitor, a driving transistor, a light emitting control sub-circuit and a light emitting sub-circuit. The compensation sub-circuit may write a threshold voltage of the driving transistor into a gate of the driving transistor in a date writing stage, so that magnitude of a drive current output by the driving transistor is independent of the threshold voltage of the driving transistor in a light emitting stage.

13 Claims, 4 Drawing Sheets

(56) References Cited

FOREIGN PATENT DOCUMENTS

| | | |
|---|---|---|
| CN | 106710528 | 5/2017 |
| CN | 106782321 | 5/2017 |
| CN | 106910468 | 6/2017 |
| CN | 106935198 | 7/2017 |
| CN | 106991964 | 7/2017 |

OTHER PUBLICATIONS

Office action from U.S. Appl. No. 15/989,732 dated Oct. 23, 2019.
Office action from Chinese Application No. 201710705821.9 dated May 12, 2020.
Office action from Chinese Application No. 201710705821.9 dated Feb. 3, 2020.
Office action from Chinese Application No. 201710705821.9 dated Sep. 5, 2019.
Office action from Chinese Application No. 201710705821.9 dated May 24, 2019.
Office action from Chinese Application No. 201710705821.9 dated Dec. 24, 2018.

* cited by examiner

PIXEL CIRCUIT, DRIVING METHOD THEREOF AND DISPLAY DEVICE

CROSS REFERENCE

This application is a Continuation Application of U.S. application Ser. No. 15/989,732 based upon and claims priority to Chinese Patent Application No. 201710705821.9, filed on Aug. 17, 2017, the entire contents thereof are incorporated herein by reference.

TECHNICAL FIELD

The present disclosure relates to the technical field of display technology, and in particular, to a pixel circuit and a driving method thereof, and a display device.

BACKGROUND

A pixel circuit of an organic light emitting diode (OLED) is a circuit that controls current flowing through the OLED by a driving transistor and is mainly used in a display device. A structure of the pixel circuit of the OLED generally includes an OLED and a plurality of driving transistors.

In the related art, the pixel circuit of the OLED generally includes a switching transistor, a driving transistor, a capacitor and an OLED. The driving transistor can convert a data voltage of a data signal terminal into a drive current for driving the OLED. The magnitude of the drive current is related to a threshold voltage (Vth) of the driving transistor.

However, if the Vth of the driving transistor is different between different pixel units or the Vth of the driving transistor drifts over time, the current of the OLED flowing through each pixel unit is different, so that homogeneity of display brightness of an OLED display panel is low and a display effect is poor.

SUMMARY

In a first aspect of the present disclosure, a pixel circuit is provided. The pixel circuit includes: a reset sub-circuit, a compensation sub-circuit, a data writing sub-circuit, a storage capacitor, a driving transistor, a light emitting control sub-circuit and a light emitting sub-circuit;

the reset sub-circuit is respectively connected with a reset signal terminal, an initialization signal terminal, a reference signal terminal, a first node and a second node for outputting an initialization signal from the initialization signal terminal to the first node and outputting a reference signal from the reference signal terminal to the second node under the control of a reset signal from the reset signal terminal;

the compensation sub-circuit is respectively connected with a driving signal terminal, the first node and a third node for writing a threshold voltage of the driving transistor into the first node under the control of a driving signal from the driving signal terminal;

the data writing sub-circuit is respectively connected with the driving signal terminal, a data signal terminal, the reference signal terminal, the second node and a second electrode of the driving transistor for outputting a data signal from the data signal terminal to the second node and outputting the reference signal to the second electrode of the driving transistor under the control of the driving signal;

one end of the storage capacitor is connected with the first node and the other end thereof is connected with the second node for adjusting a potential of the first node according to a potential of the second node;

a gate of the driving transistor is connected with the first node, a first electrode of the driving transistor is connected with the third node, and the second electrode of the driving transistor is connected with one end of the light emitting sub-circuit for outputting a drive current to the light emitting sub-circuit under the drive of the first node and the third node;

the light emitting control sub-circuit is respectively connected with an enable signal terminal, a first power terminal, the reference signal terminal, the second node and the third node for outputting the reference signal to the second node and outputting a first power signal from the first power terminal to the third node under the control of an enable signal from the enable signal terminal;

one end of the light emitting sub-circuit is connected with the second electrode of the driving transistor and the other end thereof is connected with a second power terminal for emitting light under the drive of the drive current.

Optionally, the compensation sub-circuit includes: a first transistor;

a gate of the first transistor is connected with the driving signal terminal, a first electrode of the first transistor is connected with the third node, and a second electrode of the first transistor is connected with the first node.

Optionally, the reset sub-circuit includes: a second transistor and a third transistor;

a gate of the second transistor is connected with the reset signal terminal, a first electrode of the second transistor is connected with the initialization signal terminal, and a second electrode of the second transistor is connected with the first node;

a gate of the third transistor is connected with the reset signal terminal, a first electrode of the third transistor is connected with the reference signal terminal, and a second electrode of the third transistor is connected with the second node.

Optionally, the data writing sub-circuit includes: a fourth transistor and a fifth transistor;

a gate of the fourth transistor is connected with the driving signal terminal, a first electrode of the fourth transistor is connected with the data signal terminal, and a second electrode of the fourth transistor is connected with the second node;

a gate of the fifth transistor is connected with the driving signal terminal, a first electrode of the fifth transistor is connected with the reference signal terminal, and a second electrode of the fifth transistor is connected with the second electrode of the driving transistor.

Optionally, the light emitting control sub-circuit includes: a sixth transistor and a seventh transistor;

a gate of the sixth transistor is connected with the enable signal terminal, a first electrode of the sixth transistor is connected with the reference signal terminal, and a second electrode of the sixth transistor is connected with the second node;

a gate of the seventh transistor is connected with the enable signal terminal, a first electrode of the seventh transistor is connected with the first power terminal, and a second electrode of the seventh transistor is connected with the third node.

Optionally, the light emitting sub-circuit includes: an organic light emitting diode;

an anode of the organic light emitting diode is connected with the second electrode of the driving transistor, and a cathode of the organic light emitting diode is connected with the second power terminal.

Optionally, transistors are all P-type transistors.

In a second aspect of the present disclosure, a driving method of a pixel circuit is provided for driving the pixel circuit according to the first aspect. The pixel circuit includes: a reset sub-circuit, a compensation sub-circuit, a data writing sub-circuit, a storage capacitor, a driving transistor, a light emitting control sub-circuit and a light emitting sub-circuit, the driving method of the pixel circuit includes:

a reset stage, in which a reset signal provided by a reset signal terminal is at a first potential, and in which, under the control of the reset signal, the reset sub-circuit outputs an initialization signal from an initialization signal terminal to a first node and outputs the initialization signal from a reference signal terminal to a second node, the initialization signal being at a second potential;

a data writing stage, in which a driving signal provided by a driving signal terminal is at the first potential, in which the data writing sub-circuit outputs a data signal from a data signal terminal to the second node and outputs a reference signal to a second electrode of the driving transistor, and in which the compensation sub-circuit writes a threshold voltage of the driving transistor into the first node under the drive of the driving signal and a third node;

a light emitting stage, in which the light emitting control sub-circuit outputs the reference signal to the second node and outputs a first power signal from a first power terminal to the third node, in which the storage capacitor adjusts a potential of the first node, and in which, under the drive of the first node and the third node, the driving transistor outputs a drive current to the light emitting sub-circuit and drives the light emitting sub-circuit to emit light.

Optionally, the driving transistor is a P-type transistor, and the first potential is lower than the second potential.

In a third aspect of the present disclosure, a display device is provided. The display device includes:

the pixel circuit according to the first aspect.

BRIEF DESCRIPTION OF THE DRAWINGS

In order to more clearly illustrate technical solutions in embodiments of the present disclosure, accompanying drawings required in the description of the embodiments will be briefly described. It should be obvious that accompanying drawings in the following description are merely some embodiments of the present disclosure. Other drawings may also be obtained according to these accompanying drawings for those ordinary skilled in the art, without any creative work.

DETAILED DESCRIPTION

Figure 1:
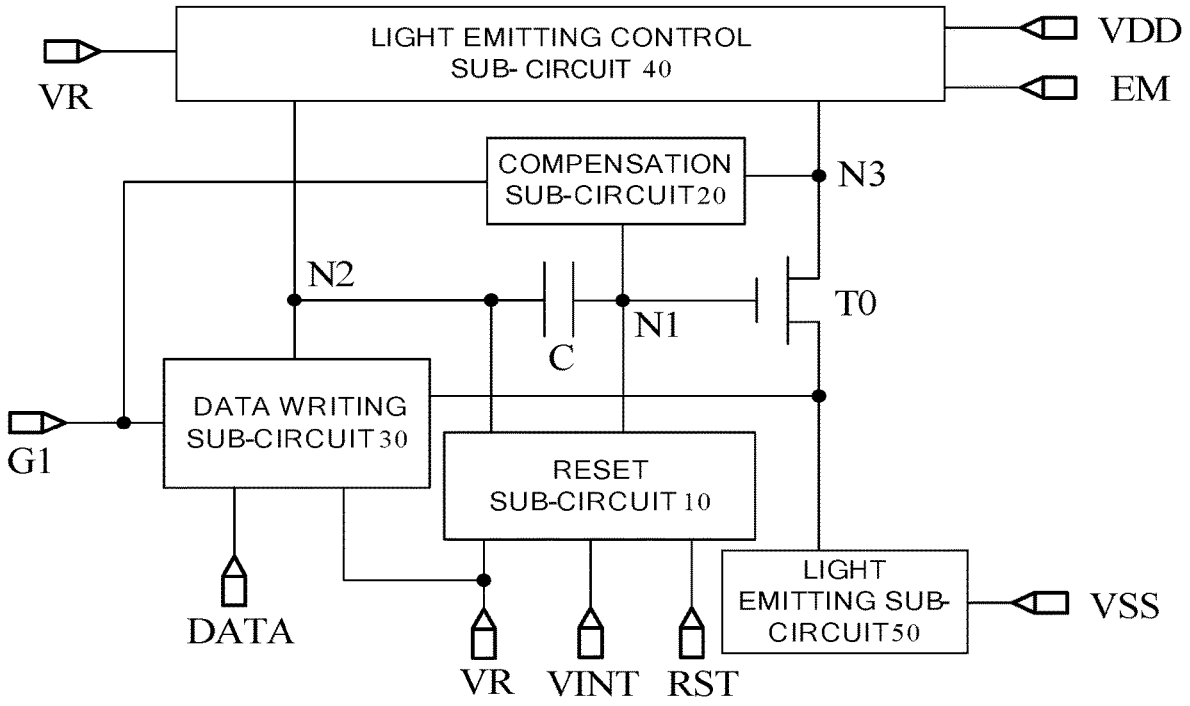
FIG. 1 is a schematic structural diagram of a pixel circuit according to an embodiment of the present disclosure.

In order to more clearly explain objectives, technical solutions and advantages 为 of the present disclosure, embodiments of the present disclosure will be further described in detail with reference to the accompanying drawings.

All transistors applied in embodiments of the present disclosure may be thin film transistors, field-effect tubes or other devices with the same characteristics, wherein a transistor applied in embodiments of the present disclosure is mainly a switching transistor according to its function in a circuit. A source electrode and a drain electrode of the switching transistor are interchangeable since the source electrode and the drain electrode applied here are symmetrical. In the embodiment of the present disclosure, the source electrode is referred to as a first electrode and the drain electrode is referred to as a second electrode. According to a form shown in the drawings, an intermediate terminal of the transistor is defined as a gate, a signal input terminal is defined as a source electrode, and a signal output terminal is defined as a drain electrode. The switching transistor applied in the embodiment of the present disclosure may be a P-type switching transistor. The P-type switching transistor is turned on when the gate is at a low level and turned off when the gate is at a high level. In addition, a plurality of signals in each embodiment of the present disclosure correspond to a first potential and a second potential. The first potential and the second potential merely represent that the potential of the signal has two state parameters, and does not represent that the first potential or the second potential in the full text has a specific value. In the embodiment of the present disclosure, the first potential is taken as an effective potential as an example.

FIG. 1 is a schematic structural diagram of a pixel circuit according to an embodiment of the present disclosure. As shown in FIG. 1, the pixel circuit may include: a reset sub-circuit 10, a compensation sub-circuit 20, a data writing sub-circuit 30, a storage capacitor C, a driving transistor T0, a light emitting control sub-circuit 40 and a light emitting sub-circuit 50.

The reset sub-circuit 10 is respectively connected with a reset signal terminal RST, an initialization signal terminal VINT, a reference signal terminal VR, a first node N1, and a second node N2, and is used for outputting an initialization signal from the initialization signal terminal VINT to the first node N1 and outputting a reference signal from the reference signal terminal VR to the second node N2 under the control of a reset signal from the reset signal terminal RST.

The compensation sub-circuit 20 is respectively connected with the driving signal terminal G1, the first node N1 and a third node N3, and is used for writing a threshold voltage of the driving transistor T0 into the first node N1 to compensate a potential of the first node N1 (i.e., a gate of the driving transistor T0) under the control of a driving signal from the driving signal terminal G1.

The data writing sub-circuit 30 is respectively connected with the driving signal terminal G1, a data signal terminal DATA, the reference signal terminal VR, the second node N2 and a second electrode of the driving transistor T0, and is used for outputting a data signal from the data signal terminal DATA to the second node N2 and outputting the reference signal to the second electrode of the driving transistor T0 under the control of the driving signal.

One end of the storage capacitor C is connected with the first node N1, and the other end is connected with the second node N2 for adjusting a potential of the first node N1 according to a potential of the second node N2.

The gate of the driving transistor T0 is connected with the first node N1, a first electrode of the driving transistor T0 is connected with the third node N3, and a second electrode is connected with one end of the lighting sub-circuit 50 for, under the drive of the first node N1 and the third node N3, outputting a drive current to the light emitting sub-circuit 50 to drive the light emitting sub-circuit 50 to emit light.

The light emitting control sub-circuit 40 is respectively connected with an enable signal terminal EM, a first power terminal VDD, the reference signal terminal VR, the second node N2 and the third node N3 for, under the control of an enable signal from the enable signal terminal EM, outputting the reference signal to the second node N2 and outputting a first power signal from the first power terminal VDD to the third node N3.

One end of the light emitting sub-circuit 50 is connected with the second electrode of the driving transistor T0, and the other end of the light emitting sub-circuit 50 is connected with a second power terminal VSS for emitting light under the drive of the drive current output by the driving transistor T0.

In conclusion, a pixel circuit is provided in an embodiment of the present disclosure, which includes a reset sub-circuit, a compensation sub-circuit, a data writing sub-circuit, a storage capacitor, a driving transistor, a light emitting control sub-circuit and a light emitting sub-circuit, wherein the compensation sub-circuit may write a threshold voltage of the driving transistor to a gate of the driving transistor in a date writing stage, so that magnitude of a drive current output by the driving transistor is independent of the threshold voltage of the driving transistor in a light emitting stage, thereby avoiding the influence of the threshold voltage drift of the driving transistor on the light emission effect and improving homogeneity of display brightness of an OLED display panel. In addition, since the compensation sub-circuit is respectively connected with a gate and a first electrode of driving transistor, a voltage difference between two electrodes of the transistor in the compensation sub-circuit is low when a low gray-scale image is displayed in the display panel, thereby avoiding negative effect on the potential of the gate of the driving transistor affected by electrical leakage of the transistor in the compensation sub-circuit, and ensuring stability of the pixel circuit during operation, and thus the display effects are improved.

Figure 2:
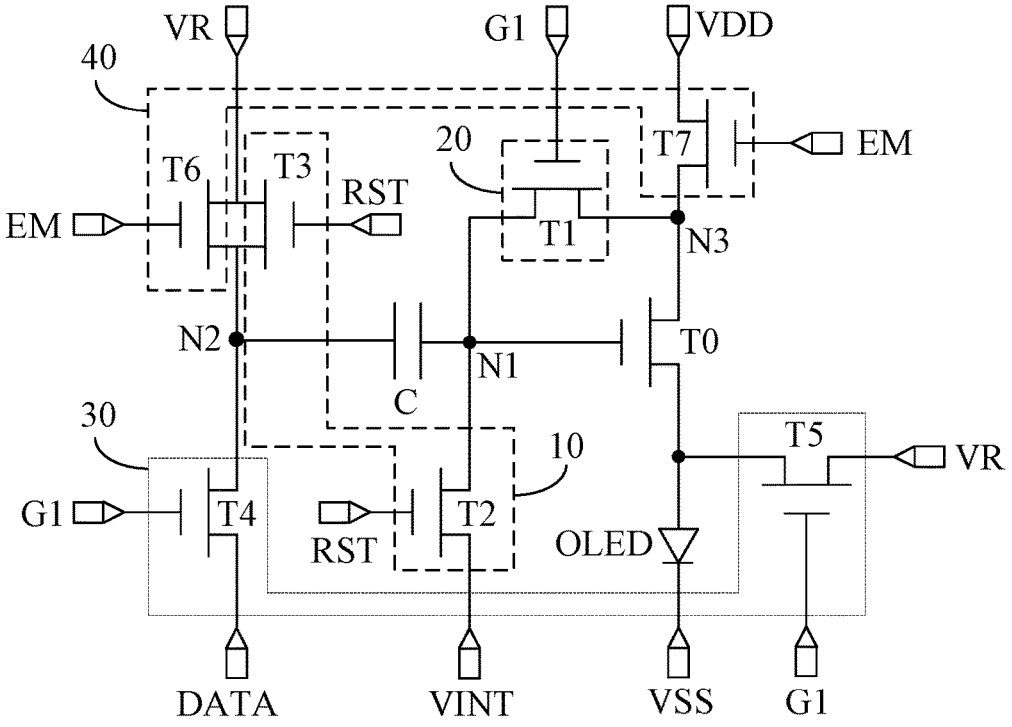
FIG. 2 is a schematic structural diagram of the other pixel circuit according to an embodiment of the present disclosure.

FIG. 2 is a schematic structural diagram of the other pixel circuit according to an embodiment of the present disclosure. Referring to FIG. 2, the compensation sub-circuit 20 may specifically include: a first transistor T1; the reset sub-circuit 10 may include: a second transistor T2 and a third transistor T3; the data writing sub-circuit 30 may include: a fourth transistor T4 and a fifth transistor T5; the light emitting control sub-circuit 40 may include: a sixth transistor T6 and a seventh transistor T7.

Among them, a gate of the first transistor T1 is connected with the driving signal terminal G1, a first electrode of the first transistor T1 is connected with the third node N3, and a second electrode of the first transistor T1 is connected with the first node N1. In the data writing stage, when the fifth transistor T5, the driving transistor T0 and the first transistor T1 are turned on, it can be seen from FIG. 2 that the first node N1 is conducted with the reference signal terminal VR so that a potential of the first node N1 is Vref+Vth, wherein the Vref is a potential of the reference signal provided by the reference signal terminal VR, the Vth is the threshold voltage of the driving transistor T0, and thus the threshold voltage Vth may be written in advance into the first node N1 (i.e., the gate of the driving transistor T0).

A gate of the second transistor T2 is connected with the reset signal terminal RST, a first electrode of the second transistor T2 is connected with the initialization signal terminal VINT, and a second electrode of the second transistor T2 is connected with the first node N1.

A gate of the third transistor T3 is connected with the reset signal terminal RST, a first electrode of the third transistor T3 is connected with the reference signal terminal VR, and a second electrode of the third transistor T3 is connected with the second node N2.

In the reset stage after the end of scanning for each frame, when a reset signal provided by the reset signal terminal RST is a first potential, the second transistor T2 and the third transistor T3 are turned on, and the initialization signal terminal VINT may output an initialization signal to the first node N1 so as to reset a potential retained by the first node N1 in the previous frame; correspondingly, the reference signal terminal VR may output the reference signal to the second node N2 so as to reset a potential retained by the second node N2 in the previous frame.

A gate of the fourth transistor T4 is connected with the driving signal terminal G1, a first electrode is connected with the data signal terminal DATA, and a second electrode is connected with the second node N2.

A gate of the fifth transistor T5 is connected with the driving signal terminal G1, a first electrode is connected with the reference signal terminal VR, and a second electrode is connected with the second electrode of the driving transistor T0.

When a driving signal provided by the driving signal terminal G1 jumps to the first potential in the data writing stage, the fourth transistor T4 and the fifth transistor T5 are turned on, and the data signal terminal DATA may write a data signal to the second node N2. At the same time, the reference signal terminal VR may output the reference signal to the second electrode of the driving transistor T0 so as to reset the second electrode of the driving transistor T0 (i.e., an anode of the OLED).

In an embodiment, a gate of the sixth transistor T6 is connected with the enable signal terminal EM, a first electrode of the sixth transistor T6 is connected with the reference signal terminal VR, and a second electrode of the sixth transistor T6 are connected with the second node N2.

A gate of the seventh transistor T7 is connected with the enable signal terminal EM, a first electrode of the seventh transistor T7 is connected with a first power terminal VDD, and a second electrode of the seventh transistor T7 is connected with the third node N3.

When an enable signal provided by the enable signal terminal EM is the first potential, the sixth transistor T6 and the seventh transistor T7 are turned on, and the reference signal terminal VR outputs a reference signal to the second node N2 and the first power terminal VDD outputs a first power signal to the third node N3. Since a potential of the second node N2 changes and a variation amount is Vref−Vdata (Vdata is a potential of the data signal), a potential of the first node N1 may correspondingly add Vref−Vdata to become 2Vref−Vdata+Vth under the coupling of the storage capacitor C. At this time, the driving transistor T0 is turned on and is able to output a drive current to the OLED, in which magnitude of the drive current is independent of the threshold voltage Vth.

As shown in FIG. 2, the light emitting sub-circuit 50 may include: an organic light emitting diode OLED. An anode of the OLED is connected with the second electrode of the driving transistor T0, and a cathode thereof is connected with the second power terminal VSS.

It should be noted that, in the embodiment of the present disclosure, the driving transistor T0 and the first to seventh transistors may all be P-type transistors.

In conclusion, a pixel circuit is provided in an embodiment of the present disclosure, which includes a reset sub-circuit, a compensation sub-circuit, a data writing sub-circuit, a storage capacitor, a driving transistor, a light emitting control sub-circuit and a light emitting sub-circuit. The compensation sub-circuit may write a threshold voltage of the driving transistor into a gate of the driving transistor in a date writing stage write, so that magnitude of a drive current output by the driving transistor is independent of the threshold voltage of the driving transistor in a light emitting stage, thereby avoiding the influence of the threshold voltage drift of the driving transistor on the light emission effect and improving homogeneity of display brightness of an OLED display panel. In addition, since the compensation sub-circuit is respectively connected with a gate and a first electrode of driving transistor, a voltage difference between two electrodes of the transistor in the compensation sub-circuit is low when a low-grayscale image is displayed in the display panel, thereby avoiding negative effect on the potential of the gate of the driving transistor affected by electrical leakage of the transistor in the compensation sub-circuit, and ensuring stability of the pixel circuit during operation, and thus the display effects are improved.

Figure 3:
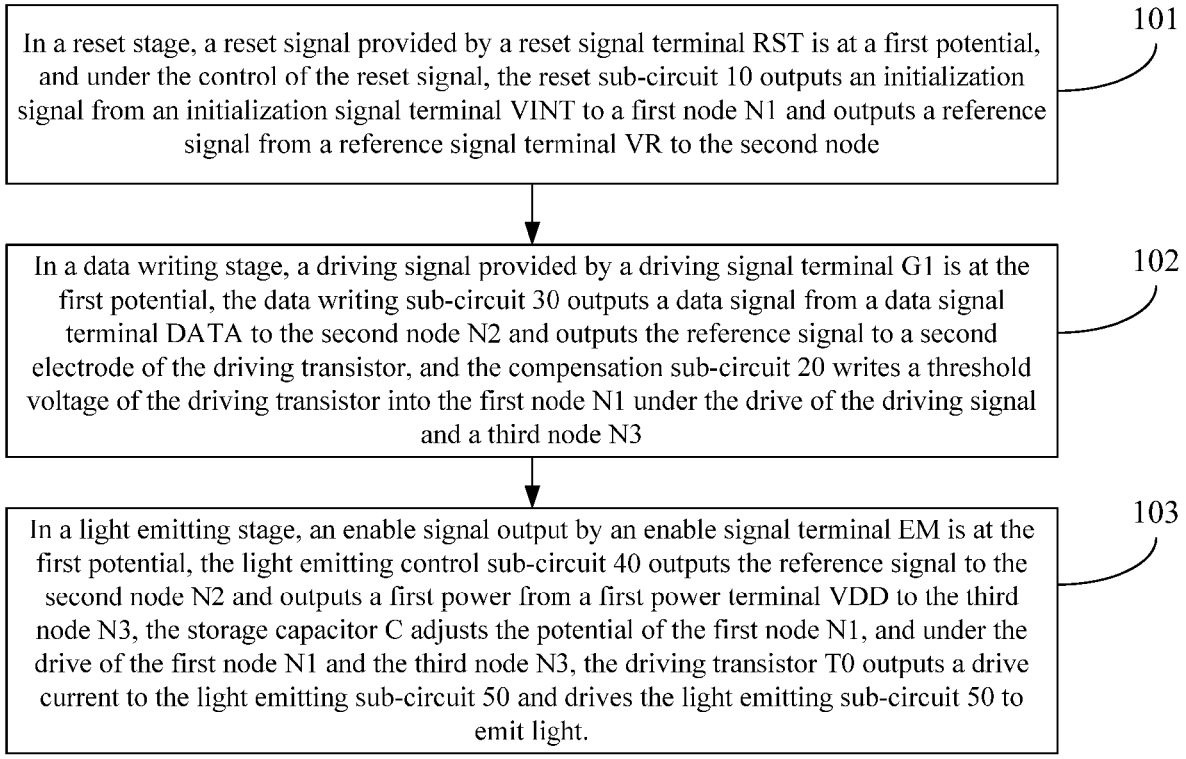
FIG. 3 is a flowchart of a driving method of a pixel circuit according to an embodiment of the present disclosure.

FIG. 3 is a flowchart of a driving method of a pixel circuit according to an embodiment of the present disclosure for driving the pixel circuit as shown in FIG. 1 or 2. The pixel circuit may include a reset sub-circuit 10, a compensation sub-circuit 20, a data writing sub-circuit 30, a storage capacitor C, a driving transistor T0, a light emitting control sub-circuit 40 and a light emitting sub-circuit 50. Referring to FIG. 3, the driving method of the pixel circuit may include the following steps.

Step 101: in a reset stage, a reset signal provided by a reset signal terminal RST is a first potential, and under the control of the reset signal, the reset sub-circuit 10 outputs an initialization signal from an initialization signal terminal VINT to a first node N1 and outputs a reference signal from a reference signal terminal VR to the second node N2, In Step 101, a potential of the initialization signal may be a second potential and the initialization signal may be used to reset the first node N1; a potential of the initialization signal may be a second potential and the initialization signal may be used to reset the first node N1.

Step 102: in a data writing stage, a driving signal provided by a driving signal terminal G1 is the first potential, the data writing sub-circuit 30 outputs a data signal from a data signal terminal DATA to the second node N2 and outputs the reference signal to a second electrode of the driving transistor, and the compensation sub-circuit 20 writes a threshold voltage of the driving transistor into the first node N1 under the drive of the driving signal and a third node N3.

Step 103: in a light emitting stage, an enable signal output by an enable signal terminal EM is the first potential, the light emitting control sub-circuit 40 outputs the reference signal to the second node N2 and outputs a first power from a first power terminal VDD to the third node N3, the storage capacitor C adjusts a potential of the first node N1, and under the drive of the first node N1 and the third node N3, the driving transistor T0 outputs a drive current to the light emitting sub-circuit 50 and drives the light emitting sub-circuit 50 to emit light.

In conclusion, a driving method of a pixel circuit is provided in an embodiment of the present disclosure, in which a compensation sub-circuit may write a threshold voltage of the driving transistor to a gate of the driving transistor in a date writing stage, so that magnitude of a drive current output by the driving transistor is independent of the threshold voltage of the driving transistor in a light emitting stage, thereby avoiding the influence of the threshold voltage drift of the driving transistor on the light emission effect and improving homogeneity of display brightness of an OLED display panel. In addition, since the compensation sub-circuit is respectively connected with a gate and a first electrode of driving transistor, a voltage difference between two electrodes of the transistor in the compensation sub-circuit is lower when a low-grayscale image is displayed in the display panel, thereby avoiding negative effect on the potential of the gate of the driving transistor affected by electrical leakage of the transistor in the compensation sub-circuit, and ensuring stability of the pixel circuit during operation.

In one embodiment, as shown in FIG. 2, in the pixel circuit provided by the embodiment of the present disclosure, the compensation sub-circuit 20 may include: a first transistor T1; the reset sub-circuit 10 may include: a second transistor T2 and a third transistor T3; the data writing sub-circuit 30 may include: a fourth transistor T4 and a fifth transistor T5; the light emitting control sub-circuit 40 may include a sixth transistor T6 and a seventh transistor T7.

Figure 4:
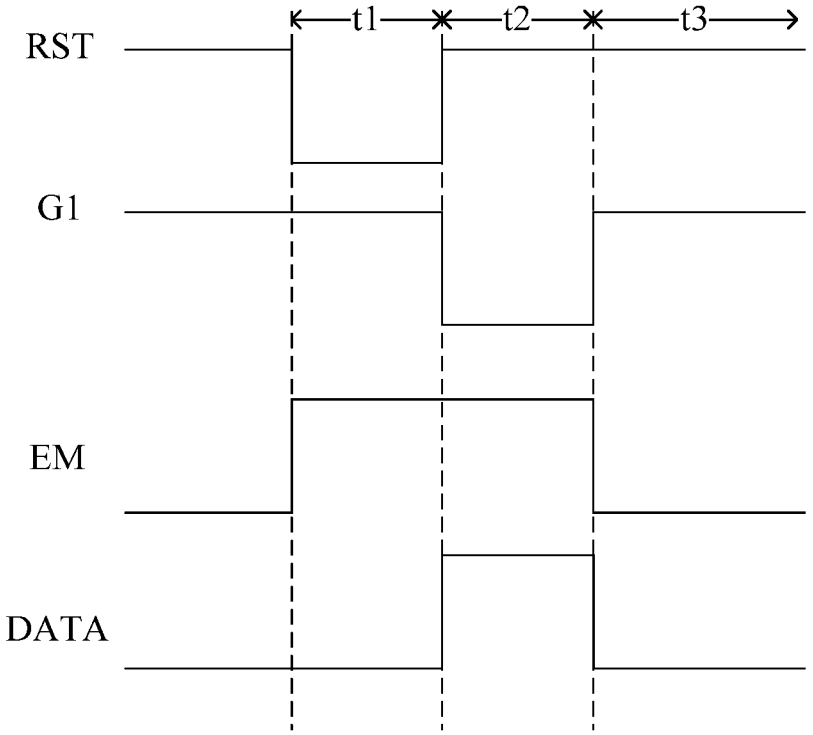
FIG. 4 is a sequence diagram of signal terminals in a driving process of a pixel circuit according to an embodiment of the present disclosure.

FIG. 4 is a sequence diagram of signal terminals in a driving process of a pixel circuit according to an embodiment of the present disclosure. A driving principle of the pixel circuit is described in detail with the pixel circuit shown in FIG. 2 taken as an example.

Figure 5:
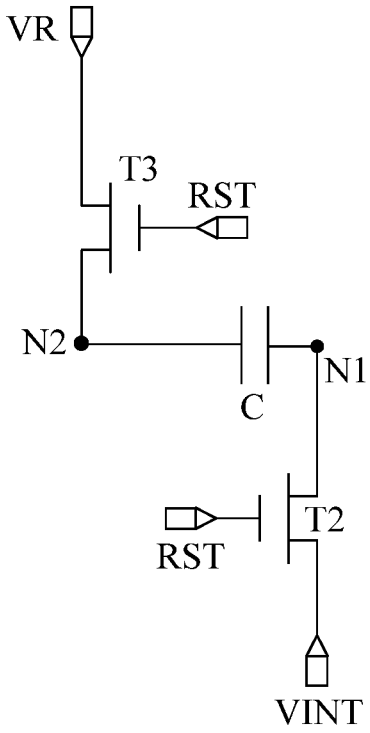
FIG. 5 is an equivalent circuit diagram of a pixel circuit in a reset stage according to an embodiment of the present disclosure.

In the reset stage t1, the reset signal provided by the reset signal terminal RST is the first potential, the first potential is an effective potential, and the second transistor T2 and the third transistor T3 are turned on. At this time, an equivalent circuit diagram of the pixel circuit may be that as shown in FIG. 5. As can be seen from FIG. 5, the initialization signal terminal VINT can output the initialization signal to the first node N1 and the reference signal terminal VR can output a reference signal to the second node N2, thereby resetting the first node N1 and the second node N2. At this time, a potential of the first node N1 may be a potential Vint of the initialization signal, and a potential of the second node N2 may be a potential Vref of the reference signal, wherein, the potential Vint may be a low potential, and the potential Vref may be preset according to an actual situation, i.e., a magnitude of the potential Vref will not be defined by the embodiment of the present disclosure.

Figure 6:
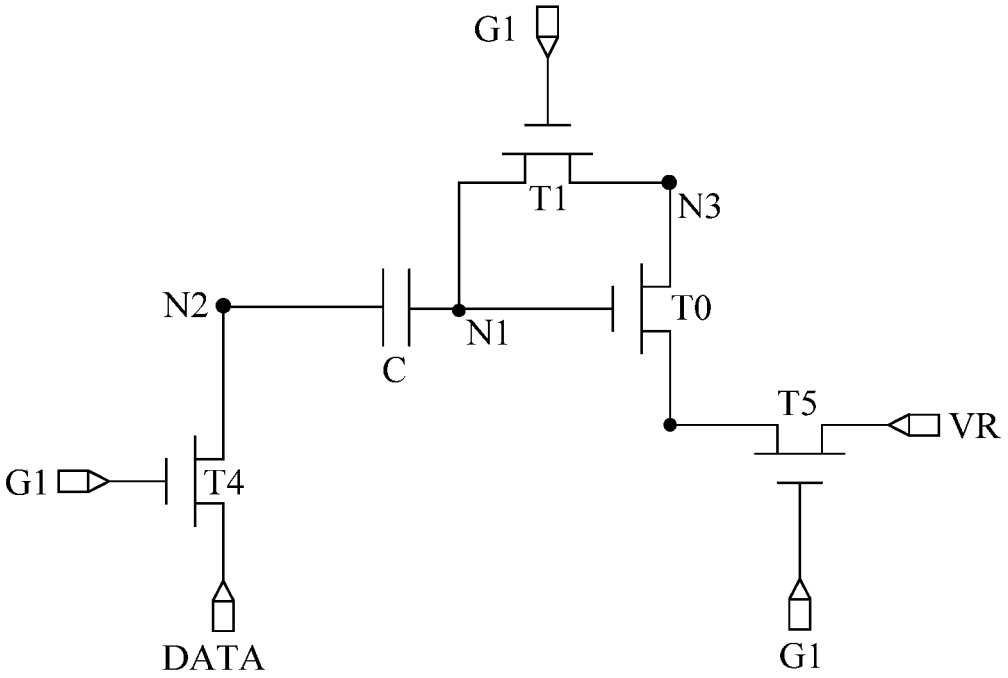
FIG. 6 is an equivalent circuit diagram of a pixel circuit in a data writing stage according to an embodiment of the present disclosure.

In the data writing stage t2, the driving signal provided by the driving signal terminal G1 is the first potential, the first transistor T1, the fourth transistor T4 and the fifth transistor T5 are turned on, and the data signal terminal DATA writes the data signal to the second node N2 in which the potential of the second node N2 is a potential Vdata of the data signal; the reference signal terminal VR outputs the reference signal to the second electrode of the driving transistor T0 (i.e., the anode of the OLED) so as to reset the anode of the OLED. In one embodiment, since the potential of the second node N2 changes, the potential of the first node N1 also changes under the coupling of the storage capacitor C and the drive transistor T0 is driven to be turned on. At this time, as shown in FIG. 6, the reference signal terminal VR is conducted with the first node N1 through the driving transistor T0 and the first transistor T1. The potential of the first node N1 at this time is: Vref+Vth, and the threshold voltage of the driving transistor T0 is Vth.

Figure 7:
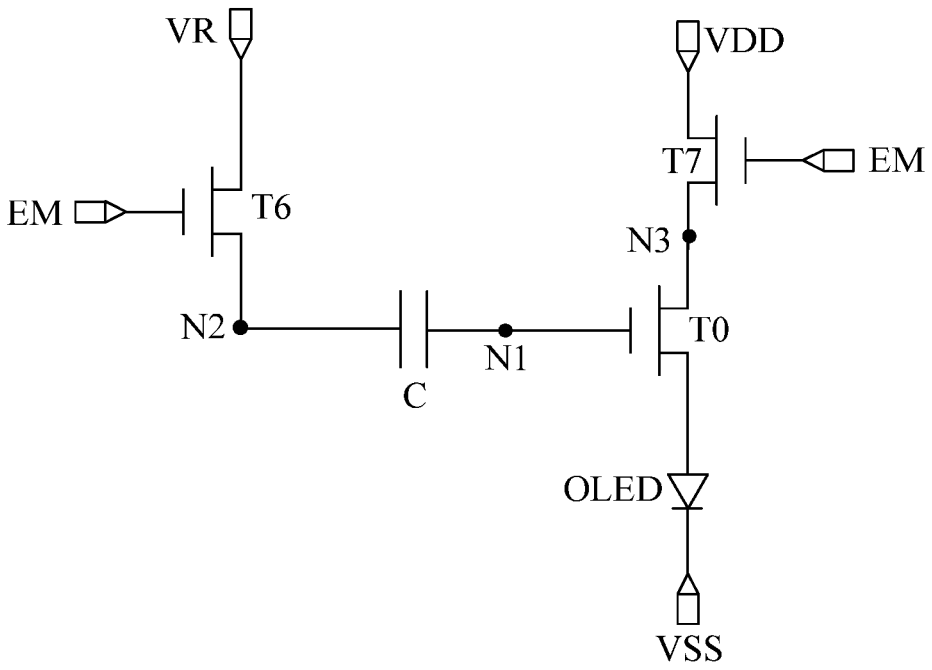
FIG. 7 is an equivalent circuit diagram of a pixel circuit in a light emitting stage according to an embodiment of the present disclosure.

In an embodiment, in the light emitting stage t3, the enable signal output by the enable signal terminal EM is the first potential, the sixth transistor T6 and the seventh transistor T7 are turned on, and the reference signal terminal VR outputs the reference signal to the second node N2, in which the potential of the second node N2 becomes Vref; the first power terminal VDD outputs a first power signal to the third node N3 (i.e., a source electrode of the driving transistor T0), in which a potential of the first power signal is Vdd. Since a variation amount of the potential of the second node N2 is Vref-Vdata, and a variation amount of the potential of the first node N1 is also Vref-Vdata under the coupling effect of the storage capacitor C, the potential of the first node N1 (i.e., the gate of the drive transistor T0) becomes: 2Vref−Vdata+Vth at this time. The driving transistor T0 is turned on under the drive of the first node N1, and outputs the drive current to the OLED to drive the OLED to emit light. An equivalent circuit diagram of the pixel circuit at this time can be that as shown in FIG. 7.

wherein, a gate-source voltage Vgs of the driving transistor T0 in the light-emitting stage t3 may be expressed as the following equation:

$$Vgs=2V\text{ref}-V\text{data}+Vth-Vdd \quad (1);$$

A drive current $I_{OLED}$ generated by the driving transistor T0 may be expressed as the following equation:

$$\begin{aligned} I_{OLED} &= \frac{1}{2}K\times(Vgs-Vth)^2 \\ &= \frac{1}{2}K\times(2Vref-Vdata+Vth-Vdd-Vth)^2 \\ &= \frac{1}{2}K\times(2Vref-Vdata-Vdd)^2; \end{aligned} \quad (2)$$

wherein, $$K=\frac{W}{L}\cdot C_{ox}\cdot\mu,$$

μ is a carrier mobility of the driving transistor T0, Cox is a capacitance of a gate insulating layer of the driving transistor T0, and W/L is an aspect ratio of the driving transistor T0. It can be seen from the equation (2) that, during a normal operation of the OLED, magnitude of the driving current $I_{OLED}$ for driving the OLED is only related to the potential Vref of the reference signal, the potential Vdata of the data signal, and the potential Vdd of the first power signal, and is independent of the threshold voltage Vth of the driving transistor T0, thereby avoiding the influence of the threshold voltage drift of the driving transistor on the light emission effect and ensuring homogeneity of display brightness of an OLED display panel.

In addition, when a low gray-scale image is displayed in the display panel, since the potential Vdata of the data signal is low, the potential of the first node N1 which is 2Vref−Vdata+Vth will correspondingly be relatively high in the light emitting stage. The first electrode of the first transistor T1 in the compensation sub-circuit 20 (i.e., the first electrode of the driving transistor T0) is connected with the third node N3 and the potential of the third node N3 and a potential Vdd of the first power signal (generally a high potential) are relatively close, so that the potential difference between the first and second electrodes of the first transistor T1 is low, thereby avoiding the leakage current of the first transistor T1 and affecting the potential of the first node N1. Therefore, the stability of the potential of the first node N1 is ensured, so that the stability of the driving current output by the driving transistor T0 is improved and the display effect of the display panel is also improved.

In addition, as an operating time of the OLED increases, a potential of the anode (i.e., the second electrode of the driving transistor T0) also changes. In the embodiment of the present disclosure, the first electrode of the first transistor T1 in the compensation sub-circuit is connected with the third node N3 (i.e., the first electrode of the driving transistor T0), therefore the potential of the first electrode of the first transistor T1 will not be affected by the change of the potential of the anode of the OLED, thereby ensuring the stability of the compensation voltage of the compensation sub-circuit 20 is stabilized and then the stability of the pixel circuit during operation.

In conclusion, a driving method of a pixel circuit is provided in an embodiment of the present disclosure, in which a compensation sub-circuit may write a threshold voltage of the driving transistor to a gate of the driving transistor in a date writing stage, so that magnitude of a drive current output by the driving transistor is independent of the threshold voltage of the driving transistor in a light emitting stage, thereby avoiding the influence of the threshold voltage drift of the driving transistor on the light emission effect and improving homogeneity of display brightness of an OLED display panel. In addition, since the compensation sub-circuit is respectively connected with a gate and a first electrode of driving transistor, a voltage difference between two electrodes of the transistor in the compensation sub-circuit is lower when a low gray-scale image is displayed in the display panel, thereby avoiding negative effect on the potential of the gate of the driving transistor affected by electrical leakage of the transistor in the compensation sub-circuit, and ensuring stability of the pixel circuit during operation.

It should be noted that, in the above embodiments, each transistor is a P-type transistor, and the first potential is a lower than the second potential. Of course, an N-type transistor may also be used for each of the transistors. When the N-type transistor is used for each transistor, the first potential may be higher than the second potential, and the potential change of each signal terminal may be opposite to the potential change as shown in FIG. 4.

An embodiment of the present disclosure provides a display device, which may include the pixel circuit as shown in FIG. 1 or 2. The display device may be any product or component having a display function such as a liquid crystal panel, an electronic paper, an OLED panel, an AMOLED panel, a mobile phone, a tablet computer, a television, a monitor, a laptop, a digital photo frame and a navigator It can be clearly understood by those skilled in the art that, in order to conveniently and briefly describe, the specific working process of the above-described circuit and sub-circuits may refer to a corresponding process in the embodiment of the foregoing method and details will not be repeated.

The foregoing descriptions are merely exemplary embodiments of the present disclosure and are not intended to limit the present disclosure. Any modifications, equivalents and improvements made within the spirit and principle of the present disclosure shall be included in the protection scope of the present disclosure.

What is claimed is:

1. A pixel circuit comprising: a reset sub-circuit, a compensation sub-circuit, a data writing sub-circuit, a storage capacitor, a driving transistor, a light emitting control sub-circuit and a light emitting sub-circuit; wherein, the reset sub-circuit is respectively connected with a reset signal terminal, an initialization signal terminal, a reference signal terminal, a first node and a second node, the reset sub-circuit is configured to output an initialization signal from the initialization signal terminal to the first node and to output a reference signal from the reference signal terminal to the second node under the control of a reset signal from the reset signal terminal, wherein the first node is a common connection point of a first end of the storage capacitor and a gate of the driving transistor, and the second node is located on a second end of the storage capacitor, wherein the second end of the storage capacitor is not connected with the driving transistor;

the compensation sub-circuit is respectively connected with a driving signal terminal, the first node and a third node, the compensation sub-circuit is configured to write a threshold voltage of the driving transistor into the first node under the control of a driving signal from the driving signal terminal, wherein the third node is located on a first electrode of the driving transistor, wherein the first electrode of the driving transistor is not connected with the light emitting sub-circuit;

the data writing sub-circuit is respectively connected with the driving signal terminal, a data signal terminal, the reference signal terminal, the second node and a second electrode of the driving transistor, for the data writing sub-circuit is configured to output a data signal from the data signal terminal to the second node and to output the reference signal to the second electrode of the driving transistor under the control of the driving signal;

the storage capacitor is for adjusting a potential of the first node according to a potential of the second node;

the second electrode of the driving transistor is connected with one end of the light emitting sub-circuit for outputting a drive current to the light emitting sub-circuit under the drive of the first node and the third node;

the light emitting control sub-circuit is respectively connected with an enable signal terminal, a first power terminal, the reference signal terminal, the second node and the third node, for the light emitting control sub-circuit is configured to output the reference signal to the second node and to output a first power signal from the first power terminal to the third node under the control of an enable signal from the enable signal terminal; and one end of the light emitting sub-circuit is connected with the second electrode of the driving transistor and the other end thereof is connected with a second power terminal for emitting light under the drive of the drive current.

2. The pixel circuit according to claim 1, wherein the compensation sub-circuit comprises: a first transistor; and wherein a gate of the first transistor is connected with the driving signal terminal, a first electrode of the first transistor is connected with the third node, and a second electrode of the first transistor is connected with the first node.

3. The pixel circuit according to claim 1, wherein the reset sub-circuit comprises: a second transistor and a third transistor;

a gate of the second transistor is connected with the reset signal terminal, a first electrode of the second transistor is connected with the initialization signal terminal, and a second electrode of the second transistor is connected with the first node; and a gate of the third transistor is connected with the reset signal terminal, a first electrode of the third transistor is connected with the reference signal terminal, and a second electrode of the third transistor is connected with the second node.

4. The pixel circuit according to claim 1, wherein the data writing sub-circuit comprises:

a fourth transistor and a fifth transistor;

a gate of the fourth transistor is connected with the driving signal terminal, a first electrode of the fourth transistor is connected with the data signal terminal, and a second electrode of the fourth transistor is connected with the second node; and a gate of the fifth transistor is connected with the driving signal terminal, a first electrode of the fifth transistor is connected with the reference signal terminal, and a second electrode of the fifth transistor is connected with the second electrode of the driving transistor.

5. The pixel circuit according to claim 1, wherein the light emitting control sub-circuit comprises: a sixth transistor and a seventh transistor;

a gate of the sixth transistor is connected with the enable signal terminal, a first electrode of the sixth transistor is connected with the reference signal terminal, and a second electrode of the sixth transistor is connected with the second node; and a gate of the seventh transistor is connected with the enable signal terminal, a first electrode of the seventh transistor is connected with the first power terminal, and a second electrode of the seventh transistor is connected with the third node.

6. The pixel circuit according to claim 1, wherein the light emitting sub-circuit comprises:

an organic light emitting diode; and an anode of the organic light emitting diode is connected with the second electrode of the driving transistor, and a cathode of the organic light emitting diode is connected with the second power terminal.

7. The pixel circuit according to claim 1, wherein the driving transistor is a P-type transistor.

8. A display device, wherein the display device comprises: the pixel circuit according to claim 1.

9. A pixel circuit, comprising: a reset sub-circuit, a compensation sub-circuit, a data writing sub-circuit, a storage capacitor, a driving transistor, a light emitting control sub-circuit and a light emitting sub-circuit, wherein, the reset sub-circuit is for, in a reset stage, in which a reset signal provided by a reset signal terminal is at a first potential, under the control of the reset signal, outputting an initialization signal from an initialization signal terminal to a first node and outputting the initialization signal from a reference signal terminal to a second node, the initialization signal being at a second potential;

the data writing sub-circuit is for, in a data writing stage, in which a driving signal provided by a driving signal terminal is at the first potential, outputting a data signal from a data signal terminal to the second node and outputting a reference signal to a second electrode of the driving transistor;

the compensation sub-circuit is for, in the data writing stage, writing a threshold voltage of the driving transistor into the first node under the drive of the driving signal and a third node;

the light emitting control sub-circuit is for, in a light emitting stage, outputting the reference signal to the second node and outputting a first power signal from a first power terminal to the third node;

the storage capacitor is for, in the light emitting stage, adjusting a potential of the first node according to a potential of the second node; and the driving transistor is for, in the light emitting stage, under the drive of the first node and the third node, outputting a drive current to the light emitting sub-circuit and driving the light emitting sub-circuit to emit light.

10. The pixel circuit according to claim 9, wherein the compensation sub-circuit comprises: a first transistor, a second transistor and a third transistor;

a gate of the first transistor is connected with the driving signal terminal, a first electrode of the first transistor is connected with the third node, and a second electrode of the first transistor is connected with the first node;

a gate of the second transistor is connected with the reset signal terminal, a first electrode of the second transistor is connected with the initialization signal terminal, and a second electrode of the second transistor is connected with the first node; and a gate of the third transistor is connected with the reset signal terminal, a first electrode of the third transistor is connected with the reference signal terminal, and a second electrode of the third transistor is connected with the second node;

wherein, in the reset stage, after the end of scanning for each frame, when a reset signal provided by the reset signal terminal is a first potential, the second transistor and the third transistor are turned on, and the initialization signal terminal outputs an initialization signal to the first node so as to reset a potential retained by the first node in the previous frame; the reference signal terminal outputs the reference signal to the second node so as to reset a potential retained by the second node in the previous frame.

11. The pixel circuit according to claim 9, wherein the data writing sub-circuit comprises:

a fourth transistor and a fifth transistor;

a gate of the fourth transistor is connected with the driving signal terminal, a first electrode of the fourth transistor is connected with the data signal terminal, and a second electrode of the fourth transistor is connected with the second node; and a gate of the fifth transistor is connected with the driving signal terminal, a first electrode of the fifth transistor is connected with the reference signal terminal, and a second electrode of the fifth transistor is connected with the second electrode of the driving transistor;

wherein, when a driving signal provided by the driving signal terminal jumps to the first potential in the data writing stage, the fourth transistor and the fifth transistor are turned on, and the data signal terminal writes a data signal to the second node, and at the same time, the reference signal terminal outputs the reference signal to the second electrode of the driving transistor so as to reset the second electrode of the driving transistor.

12. The pixel circuit according to claim 9, wherein the light emitting control sub-circuit comprises: a sixth transistor and a seventh transistor and an organic light emitting diode;

a gate of the sixth transistor is connected with the enable signal terminal, a first electrode of the sixth transistor is connected with the reference signal terminal, and a second electrode of the sixth transistor is connected with the second node;

a gate of the seventh transistor is connected with the enable signal terminal, a first electrode of the seventh transistor is connected with the first power terminal, and a second electrode of the seventh transistor is connected with the third node; and an anode of the organic light emitting diode is connected with the second electrode of the driving transistor, and a cathode of the organic light emitting diode is connected with the second power terminal;

wherein, when an enable signal provided by the enable signal terminal is the first potential, the sixth transistor and the seventh transistor are turned on, and the reference signal terminal outputs a reference signal to the second node and the first power terminal outputs a first power signal to the third node; since a potential of the second node changes, a potential of the first node increases under the coupling of the storage capacitor; and the driving transistor is turned on and outputs a drive current to the organic light emitting diode.

13. The pixel circuit according to claim 9, wherein the driving transistor is a P-type transistor, and the first potential is lower than the second potential.

* * * * *